US011377959B2

(12) United States Patent
Mitsukawa et al.

(10) Patent No.: US 11,377,959 B2
(45) Date of Patent: Jul. 5, 2022

(54) ROTOR BLADE OF AXIAL-FLOW FLUID MACHINE

(71) Applicant: IHI CORPORATION, Tokyo (JP)

(72) Inventors: Takuya Mitsukawa, Tokyo (JP); Juo Furukawa, Tokyo (JP); Masaaki Hamabe, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 17/219,977

(22) Filed: Apr. 1, 2021

(65) Prior Publication Data

US 2021/0215048 A1 Jul. 15, 2021

Related U.S. Application Data

(63) Continuation of application No. PCT/JP2019/020316, filed on May 22, 2019.

(30) Foreign Application Priority Data

Nov. 5, 2018 (JP) ..... JP2018-208241

(51) Int. Cl.
*F01D 5/14* (2006.01)

(52) U.S. Cl.
CPC ..... *F01D 5/141* (2013.01); *F05D 2220/30* (2013.01); *F05D 2240/30* (2013.01)

(58) Field of Classification Search
CPC ..... F01D 5/14; F01D 5/141; F05D 2240/30; F05D 2240/301; F05D 2240/305; F05D 2240/306; F05D 2250/70
See application file for complete search history.

(56) References Cited

U.S. PATENT DOCUMENTS 5,249,922 A 10/1993 Sato et al.
5,342,170 A 8/1994 Elvekjaer et al.
(Continued)

FOREIGN PATENT DOCUMENTS

JP 01-106903 A 4/1989
JP 04-124406 A 4/1992
JP 06-173605 A 6/1994
JP 10-508671 A 8/1998
JP 2000-018003 A 1/2000
(Continued)

OTHER PUBLICATIONS

International Search Report dated Jul. 2, 2019 in PCT/JP2019/020316 filed on May 22, 2019, 2 pages.

*Primary Examiner* — Brian P Wolcott
*Assistant Examiner* — Sang K Kim
(74) *Attorney, Agent, or Firm* — Oblon, McClelland, Maier & Neustadt, L.L.P.

(57) ABSTRACT

A rotor blade includes a blade portion that extends in a spanwise direction from a hub portion to a tip portion and has a pressure-side surface and a suction-side surface, a blade portion is formed by profiles with airfoil shapes stacked in the spanwise direction, and a stacking line connecting gravity centers of the profiles at each spanwise position is a straight line parallel to a radial direction at a part from the hub portion to an outer end of a secondary flow region in a vicinity of the hub portion, and is a curved line, along which a distance measured from the straight line parallel to the radial direction toward a side of the suction-side surface gradually increases toward the tip portion, at a part from the outer end of the secondary flow region to the tip portion.

2 Claims, 4 Drawing Sheets

(56) References Cited

U.S. PATENT DOCUMENTS

| | | | | |
|---|---|---|---|---|
| 5,525,038 | A | 6/1996 | Sharma et al. | |
| 6,331,100 | B1 | 12/2001 | Liu et al. | |
| 9,017,036 | B2 | 4/2015 | Straccia | |
| 10,414,486 | B2 * | 9/2019 | Wood | F01D 5/141 |
| 10,724,383 | B2 * | 7/2020 | Baek | F01D 5/16 |
| 2004/0170502 | A1 | 9/2004 | Talbotec et al. | |
| 2005/0106027 | A1 | 5/2005 | Harvey | |
| 2008/0152501 | A1 | 6/2008 | Greim et al. | |
| 2010/0215503 | A1 | 8/2010 | Myoren et al. | |
| 2013/0224040 | A1 * | 8/2013 | Straccia | F01D 5/141 416/242 |
| 2013/0259668 | A1 | 10/2013 | Myoren et al. | |
| 2013/0259691 | A1 * | 10/2013 | Liu | F01D 5/225 416/179 |
| 2015/0192024 | A1 * | 7/2015 | Jablonski | F04D 29/384 415/208.1 |

FOREIGN PATENT DOCUMENTS

| | | | |
|---|---|---|---|
| JP | 2001-193692 | A | 7/2001 |
| JP | 2004-285986 | A | 10/2004 |
| JP | 2005-121022 | A | 5/2005 |
| JP | 3789131 | B2 | 6/2006 |
| JP | 2006-207554 | A | 8/2006 |
| JP | 2006-299819 | A | 11/2006 |
| JP | 2007-009761 | A | 1/2007 |
| JP | 2007-056824 | A | 3/2007 |
| JP | 2008-303889 | A | 12/2008 |
| JP | 2008-545097 | A | 12/2008 |
| JP | 2010-196563 | A | 9/2010 |
| JP | 2011-074804 | A | 4/2011 |
| JP | WO2012/053024 | A1 | 4/2012 |
| JP | 2015-522132 | A | 8/2015 |
| WO | WO 2005/026501 | A1 | 3/2005 |
| WO | WO 2012/053024 | A1 | 4/2012 |

* cited by examiner

ROTOR BLADE OF AXIAL-FLOW FLUID MACHINE

TECHNICAL FIELD

The present disclosure relates to a rotor blade of an axial-flow fluid machine.

BACKGROUND ART

An axial-flow fluid machine such as a fan, a compressor, or a turbine of axial-flow type that is a component of a gas turbine engine, for example, includes one or a plurality of stages aligned in an axial direction, and each stage is composed of a plurality of stator vanes and rotor blades each disposed at equal intervals in a circumferential direction.

As an example, a rotor blade of an axial-flow turbine of a gas turbine engine is illustrated in FIG. 3. Note that the "radial direction" and the "circumferential direction" used in the following description are directions that correspond to a radial direction and a circumferential direction of the axial-flow turbine into which the rotor blade is assembled, respectively.

A rotor blade RB includes a blade portion AF that has an airfoil-shaped cross-sectional shape and a tip shroud TS and a platform PF that are coupled to end portions of the blade portion AF on an outer side and an inner side in the radial direction, respectively.

The rotor blade RB further includes a shank SK and a dovetail DT on an inner side of the platform PF in the radial direction and is attached to a disk, which is a rotating part configuring the axial-flow turbine, by fitting the dovetail DT into a groove (dovetail slot) provided in an outer peripheral surface of the disk. (not shown)

The tip shroud TS and the platform PF have shapes that form rings as a whole in a state in which all rotor blades RB are attached to the disk, and at this time, an inner surface TSi of the tip shroud TS forms an end wall (tip-side end wall) of a mainstream flow path (a flow path of combustion gas that is a working fluid) on the outer side in the radial direction while an outer surface PFo of the platform PF forms an end wall (hub-side end wall) of the main stream flow path on the inner side of the radial direction.

The blade portion AF is a part extending across the mainstream flow path and includes a leading edge LE and a trailing edge TE located on an upstream side and a downstream side in a flow direction of the combustion gas, respectively, and a concave pressure-side surface PS and a convex suction-side surface SS, each of which extends between the leading edge LE and the trailing edge TE.

Note that the tip shroud TS has a function of preventing excessive vibrations from being generated at the blade portion AF by mutually constraining end portions of the blade portions AF of adjacent rotor blades RB on the outer side in the radial direction during an operation of the axial-flow turbine and of reducing, with a seal fin TSf provided on an outer surface thereof, the amount of combustion gas making a detour on the outer side of the tip shroud TS in the radial direction and leaking from the upstream side to the downstream side.

A centrifugal force directed outward in the radial direction acts on the rotor blade RB that rotates along with the disk during the operation of the axial-flow turbine. Also, since the pressure (static pressure) of combustion gas flowing through the mainstream flow path is relatively high on the pressure-side surface PS of the blade portion AF and is relatively low on the suction-side surface SS, a gas force caused by the pressure difference between both the aforementioned surfaces acts on the blade portion AF. Further, since the blade portion AF is exposed to the flow of the combustion gas with temperature distribution in the radial direction, this also causes temperature distribution at the blade portion AF.

Actions of the centrifugal force and the gas force and the generation of the temperature distribution cause a stress (a mechanical stress caused by the centrifugal force and the gas force and a thermal stress caused by the temperature distribution) at the blade portion AF.

Among these, the gas force can be regarded as a distribution load acting on the blade portion AF cantilevered at an inner portion in the radial direction (a portion coupled to the platform PF) in a direction from the pressure-side surface PS toward the suction-side surface SS, and due to the distribution load, a bending stress (a tension state on the side of the pressure-side surface PS and a compression state on the side of the suction-side surface SS) acts on the blade portion AF.

A technique of causing the entire blade portion AF to be inclined toward the side of the suction-side surface SS in the circumferential direction for the purpose of reducing the bending stress acting on the blade portion AF has been proposed in the conventional art. This will be described below.

FIGS. 4A and 4B are schematic perspective views illustrating the shape of a blade portion of a rotor blade in the conventional art, where FIG. 4A illustrates the shape of a blade portion AF0 with no inclination in the circumferential direction and FIG. 4B illustrates the shape of a blade portion AF1, the entire of which is inclined toward the side of the suction-side surface in the circumferential direction.

As illustrated in FIGS. 4A and 4B, both the blade portions AF0 and AF1 are formed by sections (which will be referred to as profiles) P0 and P1 that are perpendicular to a radial direction R stacked in a spanwise direction (longitudinal direction) (which will be referred to as stacking). Note that both the drawings illustrate only the profiles P0 and P1 at eight spanwise positions including hub portions (root portions) and tip portions (distal end portions) of the blade portions AF0 and AF1. However, the profiles P0 and P1 at each spanwise position have the same shape, and profiles P0*h* and P1*h* at the hub portions, including the positions thereof, are completely the same.

Here, although some methods of defining a stacking form are known, the stacking form is typically defined by the shape of a line connecting gravity centers of the profiles at each spanwise position (which will be referred to as a stacking line) for a rotor blade.

In the blade portion AF0 illustrated in FIG. 4A, a stacking line SL0 connecting gravity centers G0 of the profiles P0 at each spanwise position coincides with a straight line RL that passes through a gravity center G0*h* of the profile P0*h* at the hub portion and is parallel to the radial direction R.

On the other hand, in the blade portion AF1 illustrated in FIG. 4B, a stacking line SL1 connecting gravity centers G1 of the profiles P1 at each spanwise position is a straight line inclined toward the side of a suction-side surface SS1 by an angle θ in the circumferential direction relative to a straight line RL that passes through a gravity center G1*h* of the profile P1*h* at the hub portion and is parallel to the radial direction R. In other words, the blade portion AF1 illustrated in FIG. 4B is a blade portion having, as a stacking line, the straight line SL1 obtained by causing the stacking line SL0 of the blade portion AF0 illustrated in FIG. 4A to be inclined toward the side of the suction-side surface SS1 by the angle θ in the circumferential direction.

By the stacking line SL1 being inclined toward the side of the suction-side surface SS1 in the circumferential direction with respect to the radial direction R in this manner, a moment Mc in a clockwise direction (CW) in the drawing acts on the blade portion AF1 due to a centrifugal force Fc.

On the other hand, the gas force caused by the pressure difference between the pressure-side surface PS1 and the suction-side surface SS1 of the blade portion AF1 acts in a direction from the pressure-side surface PS1 toward the suction-side surface SS1 as schematically illustrated by the arrow Fg in a representative manner. Thus, a moment Mg in a counterclockwise direction (CCW) in the drawing acts on the blade portion AF1 due to the gas force Fg.

At least a part of the moment Mg in the counterclockwise direction is offset by the moment Mc in the clockwise direction acting in this manner, and as a result, it is possible to reduce the bending stress acting on the blade portion AF1 as compared with the blade portion AF0 with no inclination.

SUMMARY OF THE DISCLOSURE

Problems to be Solved by the Disclosure

However, the blade portion AF1 illustrated in FIG. 4B has a problem that a secondary flow in a region in the vicinity of the hub portion (a region in the vicinity of the hub-side end wall) may be affected by the inclination of the stacking line SL1 and a loss due to the secondary flow (secondary flow loss) may increase as compared with the blade portion AF0 illustrated in FIG. 4A.

The present disclosure was made in view of the aforementioned problem, and an object thereof is to provide a rotor blade of an axial-flow fluid machine capable of maintaining an effect of reducing a bending stress acting on a blade portion and reducing a secondary flow loss in the vicinity of a hub-side end wall.

Means for Solving the Problems

In order to achieve the above object, an aspect of the present disclosure is directed to a rotor blade of an axial-flow fluid machine including: a blade portion that extends in a spanwise direction from a hub portion to a tip portion and has a pressure-side surface and a suction-side surface, in which the blade portion is formed by profiles with airfoil shapes stacked in the spanwise direction, and a stacking line connecting gravity centers of the profiles at each spanwise position is a straight line parallel to a radial direction at a part from the hub portion to an outer end of a secondary flow region in a vicinity of the hub portion, and is a curved line, along which a distance measured from the straight line parallel to the radial direction toward a side of the suction-side surface in a circumferential direction gradually increases toward the tip portion, at a part from the outer end of the secondary flow region to the tip portion.

Effects of the Disclosure

According to the rotor blade of the axial-flow fluid machine of the present disclosure, an excellent effect that it is possible to maintain the effect of reducing the bending stress acting on the blade portion and to reduce the secondary flow loss in the vicinity of the hub-side end wall can be achieved.

MODE FOR CARRYING OUT THE DISCLOSURE

Hereinafter, an embodiment of the present disclosure will be described in detail with reference to the drawings.

Figure 1A:
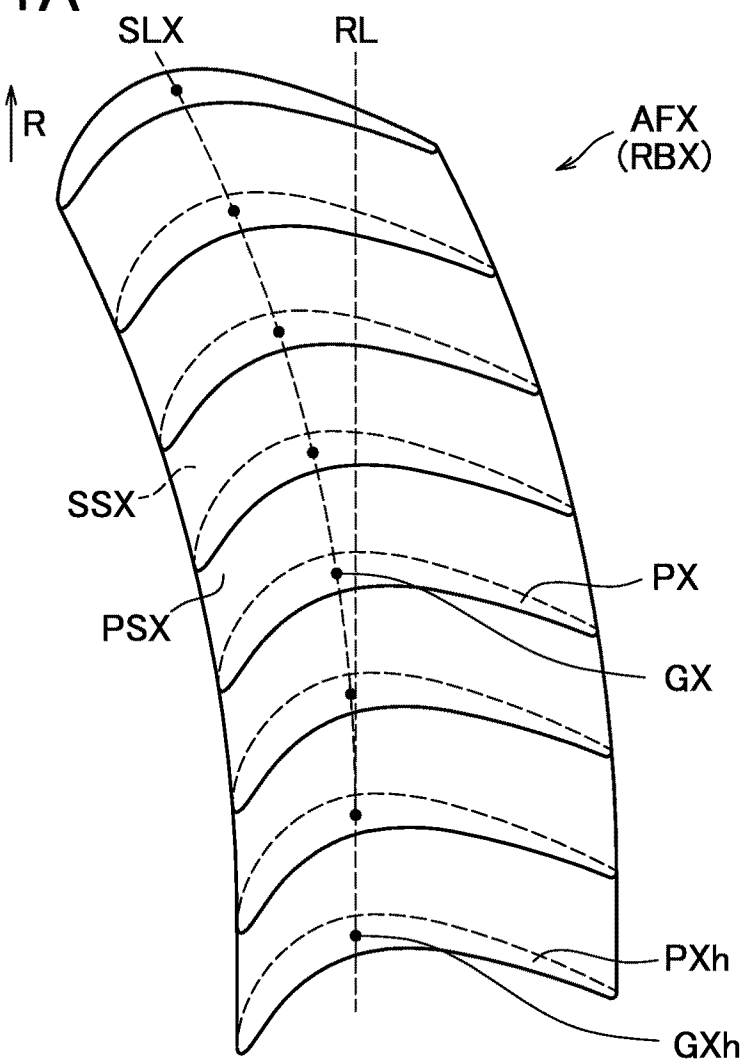
FIG. 1A is a schematic overall perspective view of a blade portion of a rotor blade of an axial-flow fluid machine according to the present disclosure.
Figure 3:
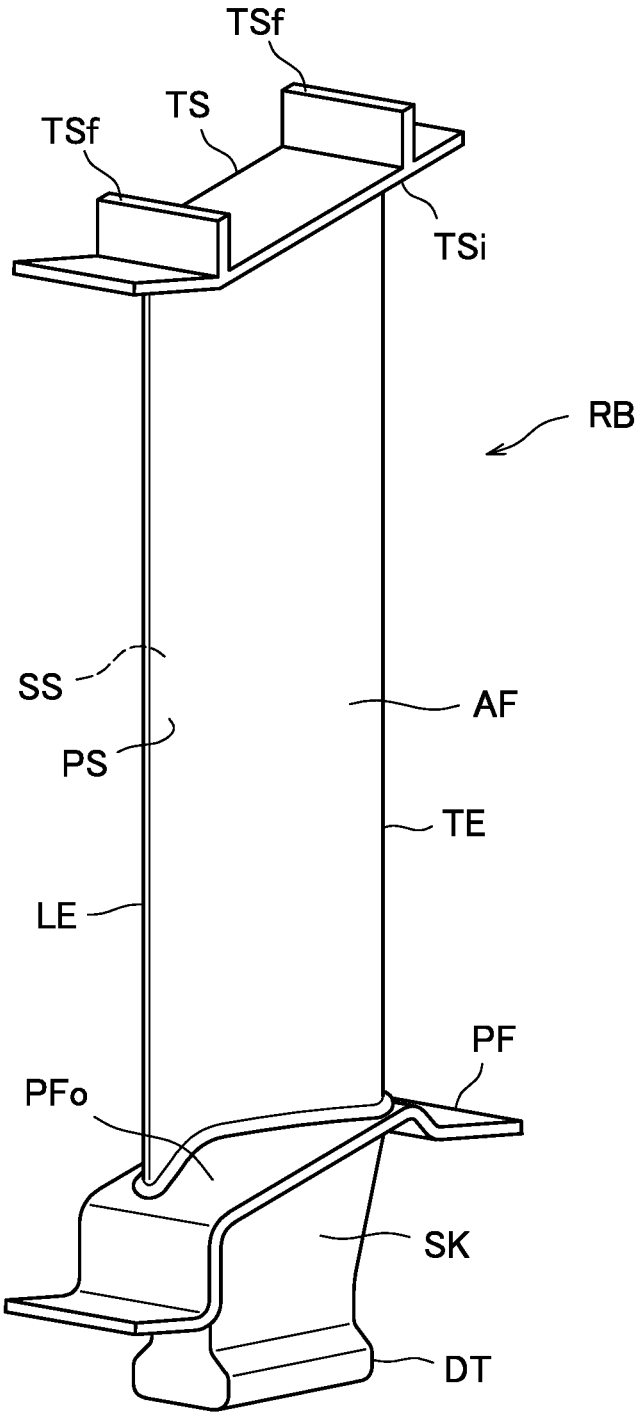
FIG. 3 is an overall schematic perspective view of a rotor blade of an axial-flow turbine of a gas turbine engine.

FIG. 1A is an overall schematic perspective view illustrating the shape of a blade portion AFX of a rotor blade RBX of an axial-flow fluid machine (a rotor blade of an axial-flow turbine of a gas turbine engine) according to the present disclosure. Note that since an overall configuration of the rotor blade RBX provided with the blade portion AFX is similar to the configuration of the rotor blade RB described above with reference to FIG. 3, repeated description will be omitted.

Figure 4B:
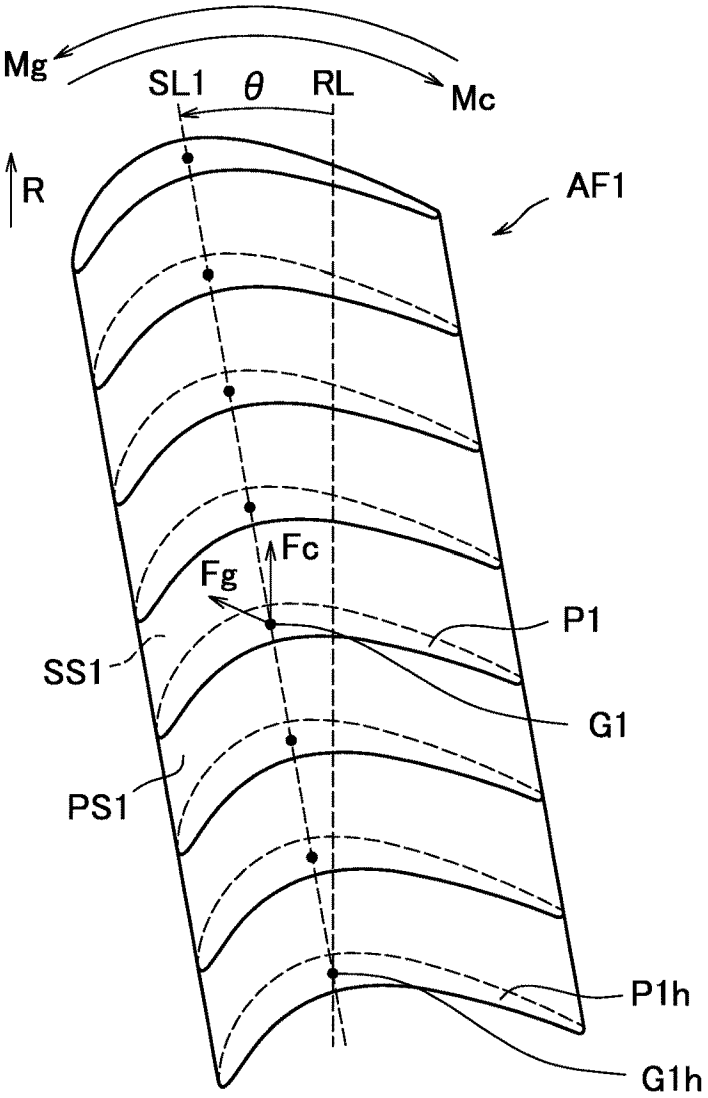
FIG. 4B is a schematic perspective view illustrating the shape of a blade portion of a rotor blade in the conventional art, and illustrates the shape of the blade portion, the entire of which is inclined toward a suction-side surface side in the circumferential direction.
Figure 4A:
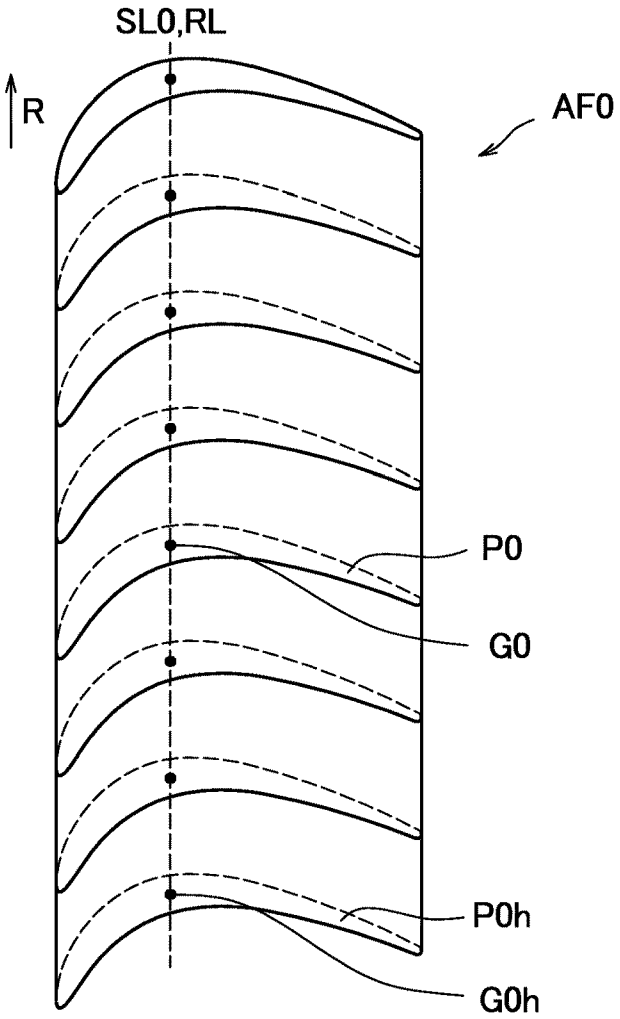
FIG. 4A is a schematic perspective view illustrating the shape of a blade portion of a rotor blade in the conventional art, and illustrates the shape of the blade portion with no inclination in the circumferential direction.

As illustrated in FIG. 1A, the blade portion AFX is formed by profiles PX stacked in a spanwise direction. Note that the drawing illustrates only the profiles PX at eight spanwise positions including a hub portion and a tip portion of the blade portion AFX. Also, in the blade portion AFX illustrated in the drawing, the shape of the profile PX at each spanwise position is the same as the shapes of the profiles P0 and P1 of the blade portions AF0 and AF1 described above with reference to FIGS. 4A and 4B, and a profile PXh at the hub portion, including the position thereof, is completely the same as the profiles P0*h* and P1*h* at the hub portions of the blade portions AF0 and AF1.

As illustrated in the drawing, a stacking line SLX of the blade portion AFX coincides with a straight line RL that passes through a gravity center GXh of the profile PXh at the hub portion and is parallel to a radial direction R in a hub-side region while beyond the region, the stacking line SLX is gradually deflected from the straight line RL toward the tip side in a region on the tip side. In this manner, the blade portion AFX has a shape curved toward the side of a suction-side surface SSX in the circumferential direction toward the tip side from an intermediate portion in the spanwise direction.

Figure 1B:
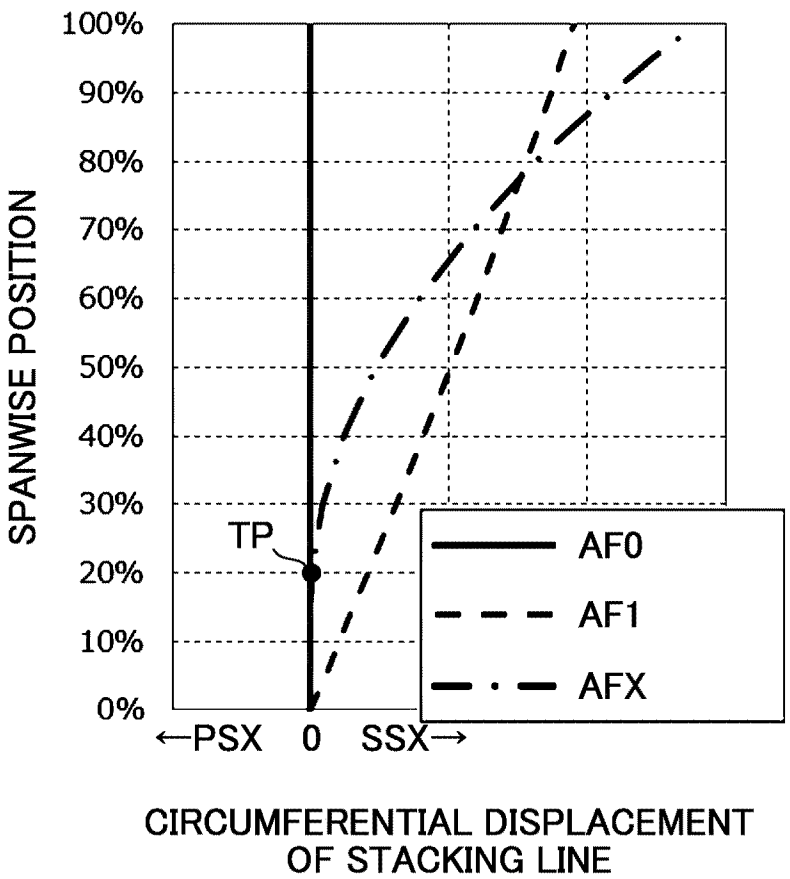
FIG. 1B is a graph illustrating a shape of a stacking line of the blade portion of the rotor blade of the axial-flow fluid machine according to the present disclosure.

FIG. 1B is a graph illustrating the shape of the stacking line SLX of the blade portion AFX. Here, the vertical axis of the graph represents a spanwise position, and the horizontal axis represents the amount of displacement of the stacking line SLX in the circumferential direction (toward the side of the suction-side surface SSX), respectively. Note that the spanwise position plotted along the vertical axis is percentage display of a non-dimensional value obtained by dividing the height of the blade portion measured from the hub portion by the entire height of the blade portion (from the hub portion to the tip portion), 0% span corresponds to the hub portion, and 100% span corresponds to the tip portion, respectively. Moreover, the drawing also illustrates, for comparison, the shapes of the stacking lines SL0 and SL1 of the blade portions AF0 and AF1 of the rotor blades in the conventional art described above in FIGS. 4A and 4B.

As illustrated in FIG. 1B, the amount of displacement of the stacking line SLX of the blade portion AFX in the circumferential direction (toward the side of the suction-side surface SSX) is zero at a part from the 0% span to the 20% span and increases at an accelerated pace at a part from the 20% span to the 100% span. In other words, the stacking line SLX of the blade portion AFX is a straight line parallel to the radial direction R at the part from the 0% span to the 20% span and is a curved line, along which the distance measured from the straight line (RL) parallel to the radial direction R toward the side of the suction-side surface SSX in the circumferential direction gradually increases toward the tip portion, at the part from the 20% span to the 100% span. That is, the spanwise position of a connecting point between the straight line and the curved line configuring the stacking line SLX of the blade portion AFX corresponds to the 20% span.

Note that the amount of displacement of the stacking line SL0 of the blade portion AF0 of the rotor blade in the circumferential direction in the conventional art illustrated for comparison is zero regardless of the spanwise position and the amount of displacement of the stacking line SL1 of the blade portion AF1 in the circumferential direction is zero at the 0% span and linearly increases up to the 100% span.

Note that the spanwise position TP from which the amount of displacement of the stacking line SLX of the blade portion AFX in the circumferential direction starts to increase (hereinafter, referred to as an inclination start position) is set at the 20% span in FIG. 1B and this is because the fact that a secondary flow region in the vicinity of a hub-side end wall is typically present in a range of 0% span to 20% span is taken into consideration. In this manner, the inclination start position TP is to be set at an outer end in the radial direction of the secondary flow region in the vicinity of the hub-side end wall recognized by analysis or a test or on the tip side beyond the outer end.

Also, the amount of displacement of the stacking line SLX on the tip side beyond the inclination start position TP in the circumferential direction can appropriately be set in consideration of a magnitude relationship between the moment Mc caused by the centrifugal force Fc generated by the stacking line SLX being inclined and the moment Mg caused by the gas force Fg acting on the blade portion AFX. Even if the amount of displacement of the stacking line SLX in the circumferential direction is zero at the part from the 0% span to the 20% span as illustrated in FIG. 1B, for example, it is possible to reduce the stress as compared with the blade portion of the rotor blade in the conventional art, by appropriately setting the amount of displacement at the part from the 20% span to the 100% span. Also, even if the amount of displacement is small, it is possible to achieve the effect of reducing the stress equivalent to that in the conventional art at an arbitrary spanwise position, by appropriately setting the amount of displacement (see FIG. 2B).

In this manner, the blade portion AFX is caused to exhibit the effect of reducing the bending stress acting on the blade portion AFX by not causing the stacking line SLX to be inclined in the circumferential direction at the part where the secondary flow region is present in the vicinity of the hub-side end wall to avoid an influence on the secondary flow and causing the stacking line SLX to be inclined toward the side of the suction-side surface SSX in the circumferential direction at the part on the tip side beyond the part where the secondary flow region is present.

Effects obtained by the blade portion AFX configured as described above will be described with reference to FIGS. 2A and 2B.

Figure 2A:
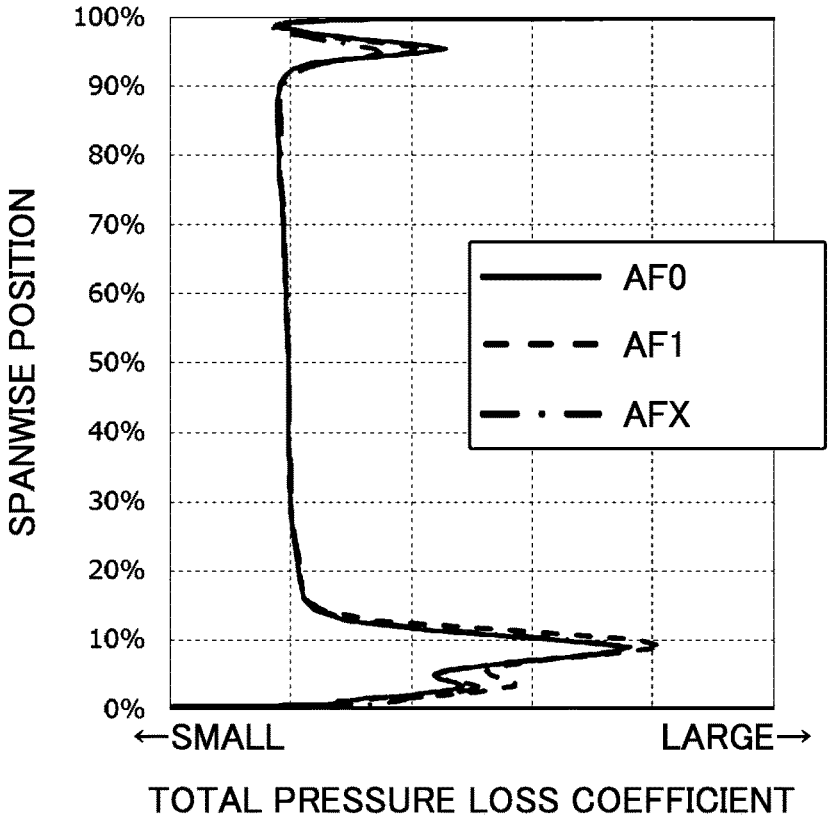
FIG. 2A is a diagram for explaining effects obtained by the blade portion of the rotor blade of the axial-flow fluid machine according to the present disclosure, and illustrates spanwise distribution of a total pressure loss coefficient.

FIG. 2A is a graph illustrating spanwise distribution of a total pressure loss coefficient obtained on the basis of a result of analyzing a flow in an inter-blade flow path of blade arrays configured by the blade portions AFX using computational fluid dynamics (CFD) in comparison with those of the blade portions AF0 and AF1. Also, FIG. 2B is a graph illustrating spanwise distribution of a stress acting on the blade portion AFX in comparison with that of the blade portion AF1.

As illustrated in FIG. 2A, although peaks of the total pressure loss coefficients due to secondary flow losses appear in the ranges of the 0% span to the 20% span where the secondary flow regions are present in the vicinity of the hub-side end walls in both the blade portions, the secondary flow loss is reduced in the blade portion AFX as compared with the blade portion AF1 in the conventional art, the entire of which is caused to be inclined toward the side of the suction-side surface in the circumferential direction (in a level equivalent to the blade portion AF0 in the conventional art with no inclination in the circumferential direction).

Figure 2B:
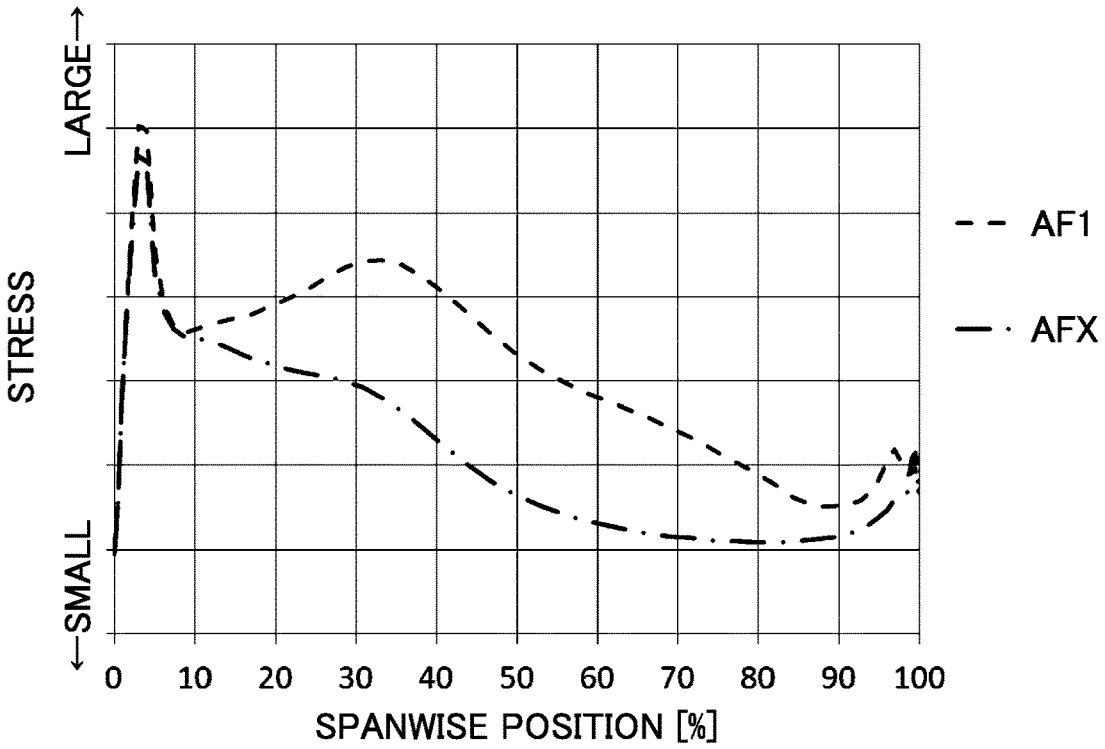
FIG. 2B is a diagram for explaining effects obtained by the blade portion of the rotor blade of the axial-flow fluid machine according to the present disclosure, and illustrates spanwise distribution of a stress.

Also, as illustrated in FIG. 2B, the stress acting on the blade portion AFX is reduced over substantially the entire region in the spanwise direction as compared with the blade portion AF1 in the conventional art, the entire of which is caused to be inclined toward the side of the suction-side surface in the circumferential direction.

According to the blade portion AFX, it is possible to reduce the stress acting on the blade portion as compared with the blade portion AF1 in the conventional art and also to reduce the secondary flow loss in the vicinity of the hub-side end wall as compared with the blade portion AF1 in the conventional art as described above.

Note that although the rotor blade according to the present disclosure has been described above as a rotor blade of an axial-flow turbine of a gas turbine engine, the present disclosure is not limited thereto. For example, the rotor blade according to the present disclosure can be widely applied to an axial-flow fluid machine such as a fan or a compressor of a gas turbine engine or a fan, a compressor, a turbine, or the like that serves as a single apparatus.

Aspects of the Disclosure

A rotor blade of an axial-flow fluid machine according to a first aspect of the present disclosure includes: a blade portion that extends in a spanwise direction from a hub portion to a tip portion and has a pressure-side surface and a suction-side surface, the blade portion is formed by profiles with airfoil shapes stacked in the spanwise direction, and a stacking line connecting gravity centers of the profiles at each spanwise position is a straight line parallel to a radial direction at a part from the hub portion to an outer end of a secondary flow region in a vicinity of the hub portion, and is a curved line, along which a distance measured from the straight line parallel to the radial direction toward a side of the suction-side surface in a circumferential direction gradually increases toward the tip portion, at a part from the outer end of the secondary flow region to the tip portion.

In the rotor blade of an axial-flow fluid machine according to a second aspect of the present disclosure, a distance from the hub portion to a connecting point between the straight line and the curved line is 20% of an entire height of the blade portion.

In the rotor blade of an axial-flow fluid machine according to a third aspect of the present disclosure, the tip portion includes a tip shroud coupled to the blade portion.

EXPLANATION OF REFERENCE SIGNS

AFX Blade portion

GX Gravity center of profile

PSX Pressure-side surface

PX Profile

RBX Rotor blade

SLX Stacking line

SSX Suction-side surface

TS Tip shroud

The invention claimed is:

1. A rotor blade of an axial-flow fluid machine comprising:

a blade portion that extends in a spanwise direction from a hub portion to a tip portion and has a pressure-side surface and a suction-side surface, wherein the blade portion is formed by profiles with airfoil shapes stacked in the spanwise direction, wherein a stacking line connecting gravity centers of the profiles at each spanwise position is a straight line parallel to a radial direction at a part from the hub portion to an outer end of a secondary flow region in a vicinity of the hub portion, and is a curved line, along which a distance measured from the straight line toward a side of the suction-side surface in a circumferential direction gradually increases toward the tip portion, at a part from the outer end of the secondary flow region to the tip portion, and wherein a distance from the hub portion to a connecting point between the straight line and the curved line is 20% of an entire height of the blade portion.

2. The rotor blade according to claim 1, wherein the tip portion includes a tip shroud coupled to the blade portion.

* * * * *